US012410577B2

(12) United States Patent
Garabedian, Jr.

(10) Patent No.: US 12,410,577 B2
(45) Date of Patent: Sep. 9, 2025

(54) SECURABLE TEMPORARY MANHOLE OR CATCH BASIN COVER

(71) Applicant: Paul Garabedian, Jr., Salem, NH (US)

(72) Inventor: Paul Garabedian, Jr., Salem, NH (US)

( * ) Notice: Subject to any disclaimer, the term of this patent is extended or adjusted under 35 U.S.C. 154(b) by 187 days.

(21) Appl. No.: 18/193,880

(22) Filed: Mar. 31, 2023

(65) Prior Publication Data

US 2024/0093459 A1 Mar. 21, 2024

Related U.S. Application Data

(63) Continuation-in-part of application No. 17/945,604, filed on Sep. 15, 2022.

(51) Int. Cl.
*E02D 29/14* (2006.01)

(52) U.S. Cl.
CPC ..... *E02D 29/14* (2013.01)

(58) Field of Classification Search
CPC ..... E02D 29/14
See application file for complete search history.

(56) References Cited

U.S. PATENT DOCUMENTS

| | | | | |
|---|---|---|---|---|
| 1,932,527 | A | 10/1933 | Long | |
| 2,813,745 | A | 11/1957 | Frieder | |
| 3,131,598 | A | 5/1964 | Bair | |
| 4,398,760 | A | 8/1983 | Kirk | |
| 4,418,432 | A | 12/1983 | Vidal | |
| 4,419,232 | A | 12/1983 | Arntyr | |
| 4,650,365 | A | 3/1987 | Runnels | |
| 5,052,851 | A * | 10/1991 | Frishauf | E02D 29/14 404/25 |
| 5,372,714 | A | 12/1994 | Logue, Jr. | |
| 5,401,114 | A * | 3/1995 | Guggemos | E02D 29/14 137/364 |
| 5,549,342 | A | 8/1996 | Donaldson | |
| 6,613,228 | B2 | 9/2003 | Petersen | |
| 7,055,440 | B2 | 6/2006 | Sisk | |
| 7,153,057 | B1 * | 12/2006 | Lucas | E02D 29/14 404/25 |

(Continued)

FOREIGN PATENT DOCUMENTS

| | | | |
|---|---|---|---|
| CN | 201981634 | U | 9/2011 |
| CN | 103696442 | A | 4/2014 |

(Continued)

*Primary Examiner* — Andrew J Triggs
(74) *Attorney, Agent, or Firm* — Lambert Shortell & Connaughton; David J. Connaughton, Jr.; Justin P. Tinger

(57) ABSTRACT

An improved securable temporary manhole or catch basin cover is disclosed herein. In one embodiment, the cover comprises a central segment attached to an inflatable element, which may be a bladder, tube, or tire. In another embodiment, an apron and/or a caulking layer is provided for the protection of the cover. Depending on the embodiment, the cover may be used with or without the apron and/or the caulking layer. In an alternate embodiment, the central segment comprises a plurality of tightening mechanisms around a perimeter of the central segment. Regardless of the embodiment, the cover disclosed herein is a unique, portable, and durable solution that improves the state of the art by facilitating the prevention of debris from falling into the sewers and allowing for easy removal of said debris from the top of the cover.

10 Claims, 13 Drawing Sheets

(56) References Cited

U.S. PATENT DOCUMENTS

| | | | | |
|---|---|---|---|---|
| 7,303,354 | B1 | 12/2007 | DeCroix | |
| 7,883,290 | B1 | 2/2011 | Ross | |
| 10,053,850 | B2 | 8/2018 | Skinner | |
| 10,392,896 | B1 * | 8/2019 | VanderLans | E21B 33/1285 |
| 11,124,958 | B1 | 9/2021 | Gagliardi | |
| D949,437 | S | 4/2022 | Hermes | |
| 2002/0023864 | A1 | 2/2002 | Petersen | |
| 2004/0007512 | A1 | 1/2004 | Petersen | |
| 2012/0103883 | A1 | 5/2012 | Friezner | |
| 2014/0064840 | A1 | 3/2014 | McInnis | |
| 2014/0328662 | A1 | 11/2014 | Whitney | |
| 2022/0081869 | A1 | 3/2022 | Putnam | |
| 2024/0093459 | A1 * | 3/2024 | Garabedian, Jr. | E02D 29/14 |
| 2024/0093460 | A1 * | 3/2024 | Garabedian, Jr. | E02D 29/14 |

FOREIGN PATENT DOCUMENTS

| | | | |
|---|---|---|---|
| EP | 1 486 619 | A2 | 12/2004 |
| WO | 2010120183 | A1 | 10/2010 |

* cited by examiner

SECURABLE TEMPORARY MANHOLE OR CATCH BASIN COVER

BACKGROUND

Technical Field

The present disclosure relates generally to an improved securable temporary manhole or catch basin cover. More particularly the present disclosure relates to an improved cover attached to a tube, tire, tubeless tire, or some product not yet developed that attaches to the walls of a manhole or catch basin when the tire or device is inflated.

Description of Related Art

Under the ubiquitous metal lids that are found on almost every street in major cities across the country and elsewhere, there are manholes with access to the sewers. These manholes are constructed from stackable sections of precast concrete that extend from the main sewer at the bottom of a hole to, ultimately, the gravel underneath the street pavement. The manhole frame and lid sit on top of the uppermost section of precast concrete, which for sewer manholes and catch basins, is the shape of an eccentric cone.

During the construction of manholes or areas near open manholes, dirt, debris, and other construction byproducts tend to fall into the sections of stacked precast concrete and into the sewers below. Fallen debris may impede sewer flow and is generally deleterious to the functioning of the sewer. A manhole is installed to change the direction of a sewer or drain line. The base section with the pipe opening is the first section to install. The base section is usually backfilled and compacted one to two feet from the top of the section installed in the ground. Next, the upper concrete sections are installed and backfilled, like the first section, up to the cone section.

After placing the cone section, a large steel plate covers the round opening. The builders of the trough would remove the plate and construct the necessary troughs in the base of the manhole. It is easier to work without the manhole frame on the cone section. Notably, a catch basin has no troughs, only a sewer and drain manhole. Upon completing the trough, the steel plate is re-installed over the opening, and the necessary fill and gravel will be brought to the subgrade, followed by the asphalt binder course. Later, asphalt and gravel will be removed above and around the steel plate wide enough to install the necessary masonry and metal frame.

After cleaning and removing the steel plate, the manhole is open to the falling of debris, which may become lodged in the sewers below. The severity of this problem increases as the height of the stackable sections of concrete increases, with the problem being the most pronounced at the top of the uppermost eccentric cone section. This problem is also prominent in the construction of, and areas around, catch basins or drain manholes with troughs. Catch basins usually have 2' or 3' sumps, whereas drain manholes have a sump like a sewer manhole.

While solutions such as temporary manhole covers have been tried, none have proved to be effective, durable, or lasting solutions over time. Therefore, what is needed is an improved securable temporary manhole or catch basin cover having the following characteristics and benefits over the prior art.

SUMMARY

The subject matter of this application may involve, in some cases, interrelated products, alternative solutions to a particular problem, and/or a plurality of different uses of a single system or article.

In one aspect, a device is disclosed. In this aspect, the device comprises a central segment having a top, a bottom, and a perimeter. Also in this aspect, the central segment has a taper and a lip around its perimeter, and the lip is attached to an inflatable tube or tire, which also encompasses the perimeter of the central segment. Finally, in this aspect, the top of the central segment comprises a handle.

In another aspect, a similar device is disclosed. In this aspect, the device comprises the central segment having a top, bottom, and perimeter. However, instead of an inflatable tube or tire attached around the perimeter of the device, this aspect comprises a first plurality of plates around the perimeter, wherein the first plurality of plates are attached to a plurality of tightening mechanisms on top of the central segment.

In yet another aspect, a method of using an improved securable temporary manhole or catch basin cover is disclosed. In this aspect, the cover comprises the same features as those disclosed in the aspect having an inflatable tube or tire. Also in this aspect, the method comprises the steps of: securing the cover to the top of an eccentric cone section of precast concrete; inflating the tube or tire until the cover is secured to the walls of a manhole, positioned within the approximate four inches of vertical space at the top of the eccentric cone section.

DETAILED DESCRIPTION

Figure 1:
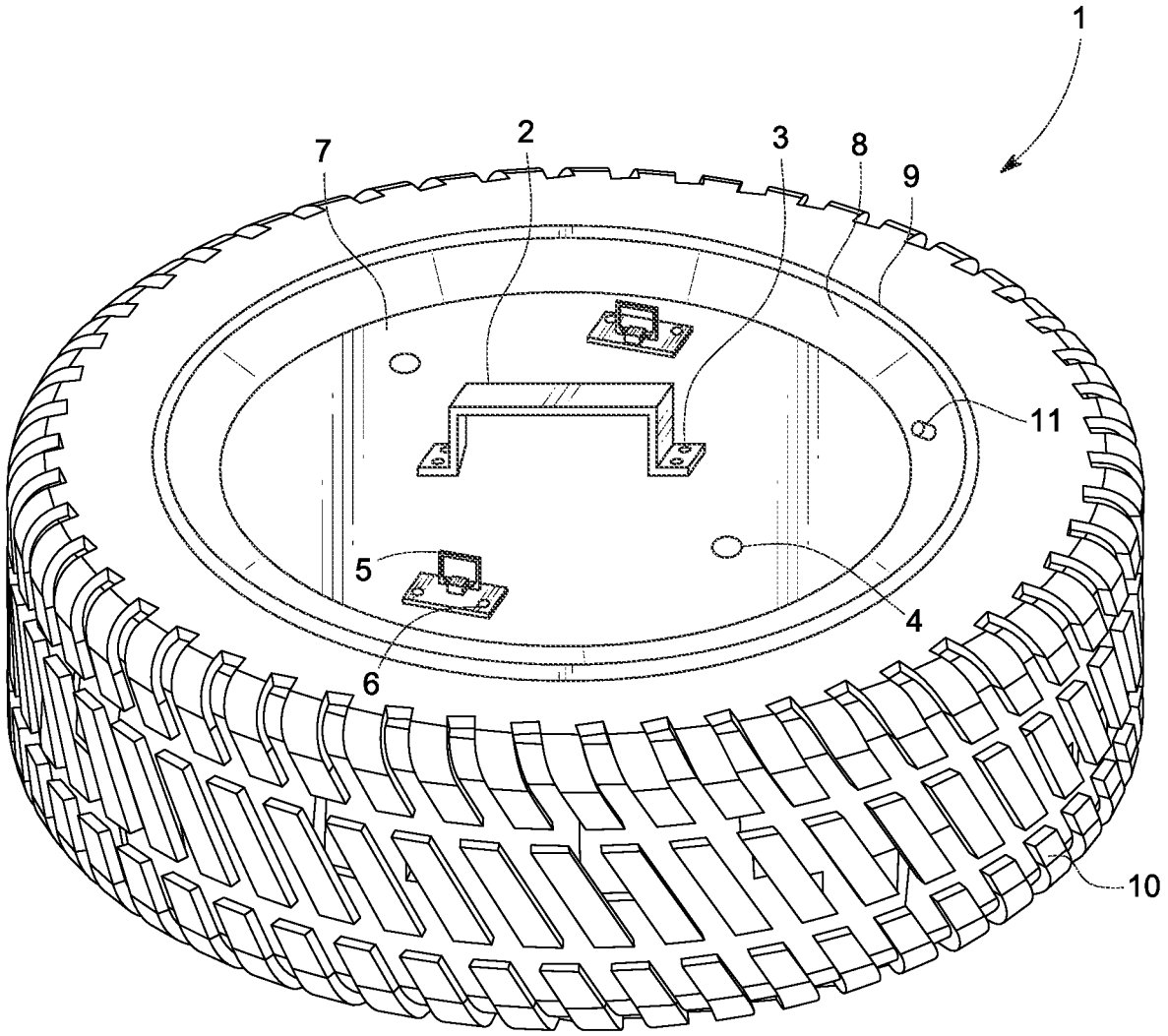
FIG. 1 provides an angled perspective view of an inflated embodiment of the present disclosure.
Figure 2:
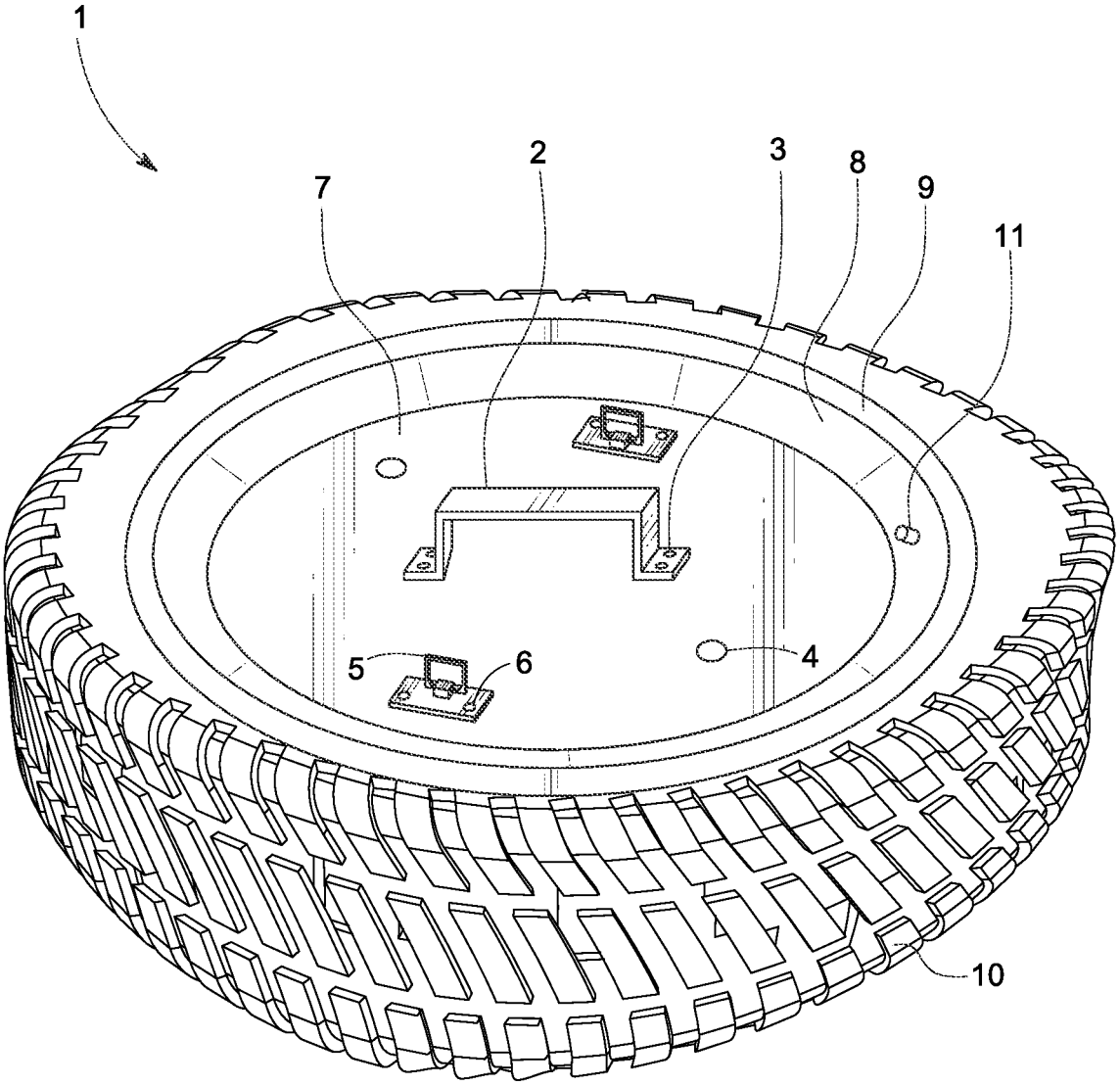
FIG. 2 provides an angled perspective view of a deflated embodiment of the present disclosure.
Figure 3:
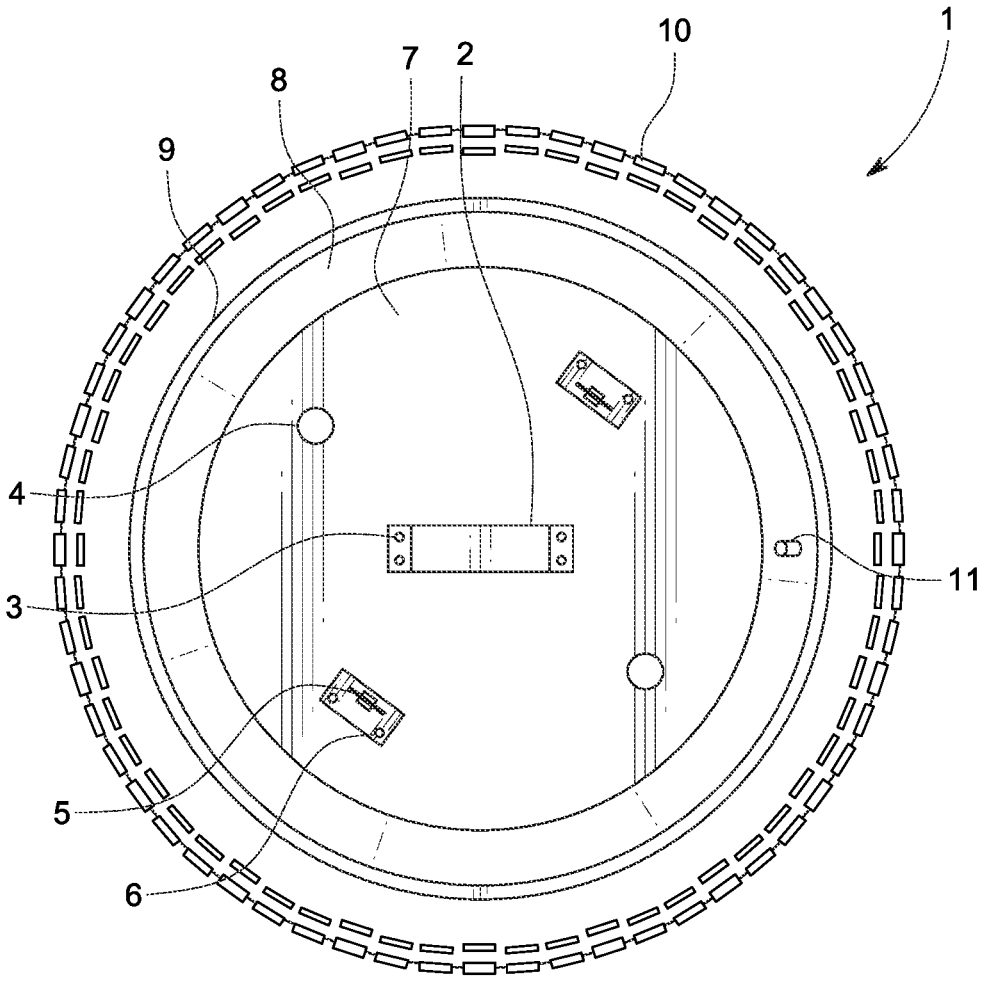
FIG. 3 provides a top perspective view of an inflated embodiment of the present disclosure.

The detailed description set forth below in connection with the appended drawings is intended as a description of presently preferred embodiments of the invention and does not represent the only forms in which the present disclosure may be constructed and/or utilized. It should be expressly understood that the various physical elements of the present disclosure summarized and further disclosed herein may be of varying sizes, shapes, or otherwise dimensions and made from a variety of different materials or methods of manufacture without straying from the scope of the present disclosure. The description merely sets forth the functions and the sequence of steps for constructing and operating the invention in connection with the illustrated embodiments.

Generally, the present disclosure concerns an improved securable temporary manhole or catch basin cover. In one embodiment, the cover may comprise a central segment attached to an inflatable element, wherein the inflatable element may be an inflatable bladder, tube, or tire. When used herein, it should be expressly understood that the terms, "bladder," "tube," and "tire" may be considered synonymous when used to describe particular embodiments. While these terms may be synonymous, they may be understood as referring to separate structures when more than one of these terms are used alternatively in the claims.

Turning back to the present disclosure, in most embodiments, the central segment and the inflatable tube may be generally circular in shape to correspondingly fit the shape of a manhole opening. In a preferred embodiment, the central segment is constructed from a plastic polymer, or carbon fiber material which is superior for its combination of durability and low weight. Similarly, in the preferred embodiment, the inflatable tube is constructed from a rubber material. While the combination of a plastic polymer, carbon fiber central segment attached to an inflatable rubber tube may provide for a superior product, the device disclosed herein may be made from any suitable material.

In another embodiment, the cover may comprise a central segment attached to a plurality of plates that may secure the cover to the walls of the manhole by applying pressure to the walls via a tightening mechanism. Each individual tightening mechanism may include at least one track and a second plate in addition to the first plate. The second plate may be attached to at least one internally threaded screw casing with a screw, which may extend through the casing. The tightening mechanism may cause the first plate to apply pressure to the wall via a tightening of the screw, which may cause the first to slide in an opposite direction from a stationary second plate until a maximum pressure is achieved.

The purpose of the present disclosure is to provide a solution to the problem of debris falling into the sewer system at the bottom of a manhole, particularly during the construction of a manhole. The problem is most pronounced at the top of the uppermost eccentric cone section of precast concrete because that is where it is most difficult to retrieve fallen debris. Similar solutions to the same or a similar problem have been tried, but these other solutions have proven ineffective over time.

One of the improvements offered by the present disclosure is the use of durable and lightweight composite material in the construction of the central segment of the cover, such as a composite material comprising a plastic polymer, carbon fiber, or other material. Other known solutions are constructed with a metal material, which is not preferred, due to its weight and rigidity. However, while the use of metal is not preferred, it may be utilized without straying from the scope of the present disclosure.

Another improvement offered by the present disclosure is that the cover and its various elements are extremely compact, being able to fit within three to four inches (3-4") of vertical space, when fully inflated, and less than approximately 24" or 30" of horizontal space, when deflated, in preferred embodiments. When used herein to refer to the metric inches, the term "approximately" shall mean±1". In addition to being heavy, other known solutions are also bulky, and thus not suited for insertion through the top of a manhole opening or frame. The improved cover disclosed herein may not only be inserted through the top of a manhole frame, but it may also be secured above the eccentric cone portion of the uppermost section of precast concrete, yet below the manhole frame. This positioning of the cover at the top of the manhole is superior to other known solutions because it allows for easy insertion and removal of not only the cover, but also the removal of debris that may fall on the cover during construction.

Moreover, yet another improvement offered by the present disclosure is the removal of sealing veins from the design of the inflatable tube embodiment. Other solutions have employed the use of sealing veins or flanges that purportedly served to enhance the efficiency of a friction seal forced between an inflatable tube and the walls of a manhole. However, sealing veins or flanges are unreliable and wear down from consistent use, thus causing the friction seal between the inflatable tube and the manhole walls to degrade over time. For these reasons, the cover disclosed herein does not comprise any sealing veins or analogous structures.

In some embodiments, an apron, or a covering layer may be used to protect the inflatable element from being damaged by falling debris. The apron may encompass the entirety of the inflatable element and be secured to the cover by at least one fixing piece. The fixing piece(s) may have any shape, but, in a preferred embodiment, the fixing piece is circular. In addition to the apron, a flap may be attached to the cover to protect the air inlet valve that allows the inflatable tube to be inflated and deflated. Both the flap and the fixing piece may be secured to the cover by bolts or screws. While the apron is preferably made from a rubber material, it should be expressly understood that other suitable materials may be used in the construction of the apron.

In some embodiments a caulking layer may be used around the seam between the tire and the seat holding the tire in place (i.e., between the lip or rim of the cover and the tire). This caulking layer may prevent dust, dirt, and smaller falling debris from degrading the seal between the tire and the cover. Said caulking may be used alternatively or simultaneously with the embodiments of the cover that utilize the apron. In one embodiment, a sealing tape may be used to seal the space between the rim of the cover and the tire. In such an embodiment, the sealing tape may be waterproof. Similarly, the sealing tape may be used alternatively or simultaneously with the embodiments of the cover that utilize the apron and/or the caulking.

While the cover may be advantageously used with the apron, the caulking, and/or the sealing tape, some embodiments of the cover may be used without any one or a combination of these elements. For example, in some embodiments, the seal between the tire and the cover may be sufficiently strong so as to not require caulking and/or sealing tape. Similarly, in some embodiments, the inflatable element secured to the cover may be a tire that is capable of withstanding repeated blows from large falling debris so as to not require an apron or an additional covering layer. In most embodiments, a flap covering the air inlet valve may be necessary.

Turning now to FIGS. 1-5, a preferred embodiment of the cover 1 comprises a removable lifting handle 2 secured to the top of the cover 1 by screws 3. The cover 1 also comprises at least two mounting holes 4 for attaching several covers 1 to each other. Depending on the depth that the cover 1 is placed in a manhole, removal of the cover 1 may require lifting by a hook or similar connection. Accordingly, the preferred embodiment of the cover 1 also includes at least one removable lifting ring 5 secured to the top of the cover 1 by screws 6.

Figure 4:
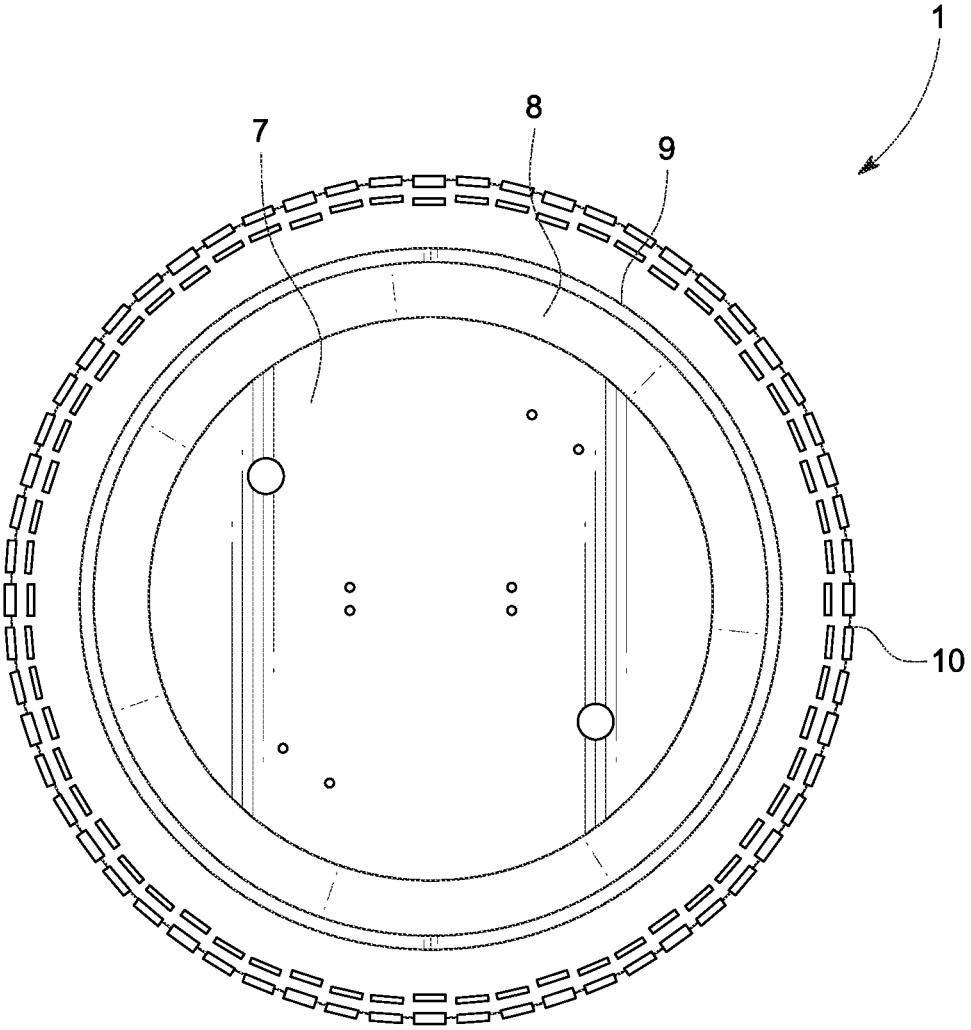
FIG. 4 provides a bottom perspective view of an inflated embodiment of the present disclosure.
Figure 5:
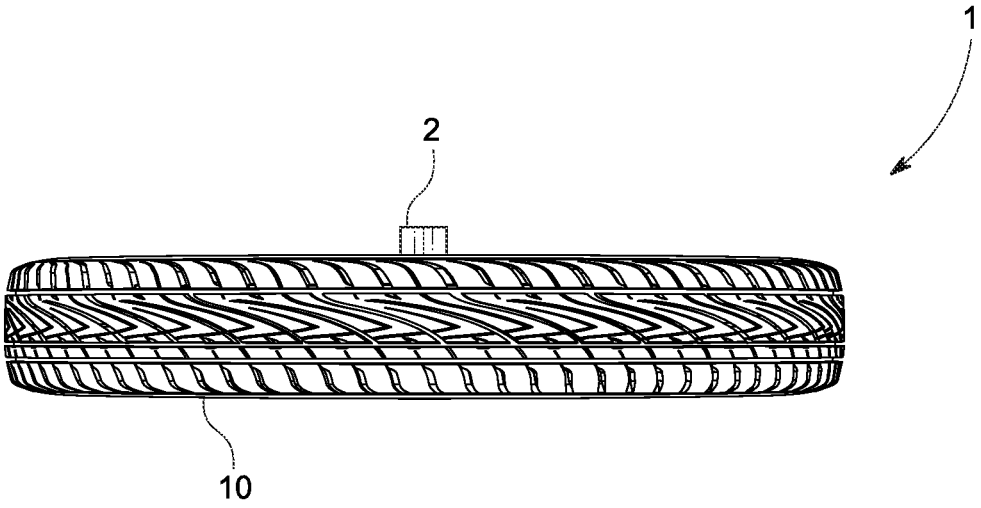
FIG. 5 provides a side perspective view of an inflated embodiment of the present disclosure.

The various elements described immediately above are located on top of the central segment 7 of the cover 1. Notably, as shown in FIG. 4, the bottom of the cover 1 only comprises the mounting holes 4, and the screws, nuts, or other related hardware that mounts the lifting handle 2 and lifting rings 5 to the central segment 7. In this embodiment, and referring back to FIGS. 1-3, the central segment 7 is generally circular in shape and includes a taper 8 around its perimeter (also shown in FIG. 4). The taper 8 is inclined relative to the central segment 7, which also comprises a lip or rim 9 around the perimeter of the taper 8. The lip 9 attaches the central segment 7 to an inflatable tube 10, which is used to apply pressure to the concrete walls of the manhole and hold the cover 1 in place. In this embodiment, an air inlet valve 11 is used to inflate and deflate the tube 10.

Figure 6:
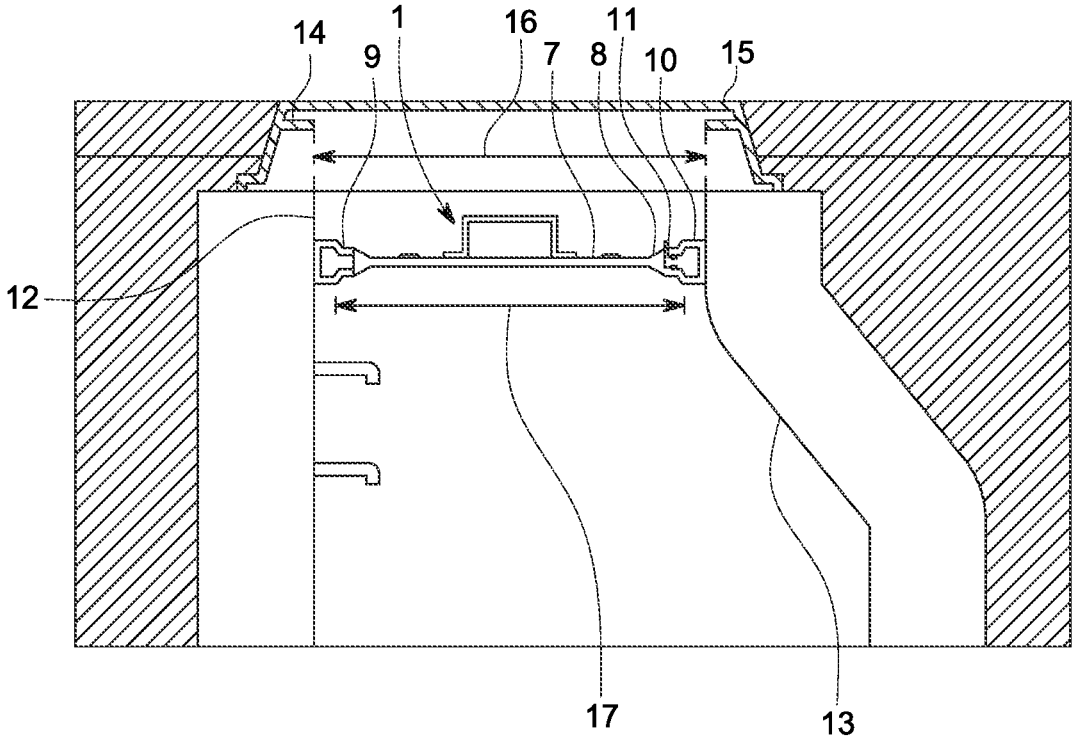
FIG. 6 provides a cross sectional perspective view of an embodiment of the present disclosure secured to the top of a manhole.

Turning now to FIG. 6, which provides a cross sectional view of the cover 1 secured to the top 12 of a section of precast concrete having the shape of an eccentric cone 13, the tube 10 is inflated via the air inlet valve 11. In this embodiment, the air inlet valve 11 is located on and protrudes from approximately the center of the taper 8. As used herein the terminology "approximately the center of the taper 8" refers to a placement for the valve 11 that is neither the top of the taper 8, proximate to the rim 9, nor the bottom of the taper 8, proximate to the edge of the central segment 7. The positioning of the cover 1 in the manhole illustrates the criticality of the cover's dimensions. Specifically, the cover 1 must be able to be inserted into the top 12 of the manhole and removed through the top 14 of the manhole frame 15. In both instances, it is preferred that the cover 1 be deflated before insertion and removal in order to facilitate a seamless transition.

Catch basin openings are 24" in diameter, and sewer manhole openings are 30" in diameter. In this embodiment, the diameter 16 at the top 12 of the eccentric cone 13 section of precast concrete is the same as the diameter 16 at the top 14 of the manhole frame 15, namely, 30". In other embodiments, the diameter at the top 14 of the manhole frame 15 may be slightly larger (e.g., 30.5"); however, most manhole frame openings are approximately 30" in diameter. When deflated, the tube 10 should not significantly impact the dimensions of the cover 1 in a way that may prevent a user from being able to insert or remove it from the manhole. Accordingly, it is only critical that the diameter 17 of the central segment 7 from rim to rim 9 be less than 30". In another embodiment, where the cover is used to prevent the accumulation of debris in a catch basin, it is critical that the width or diameter of the cover be less than 24" for reasons similar to those immediately stated above.

Figure 7:
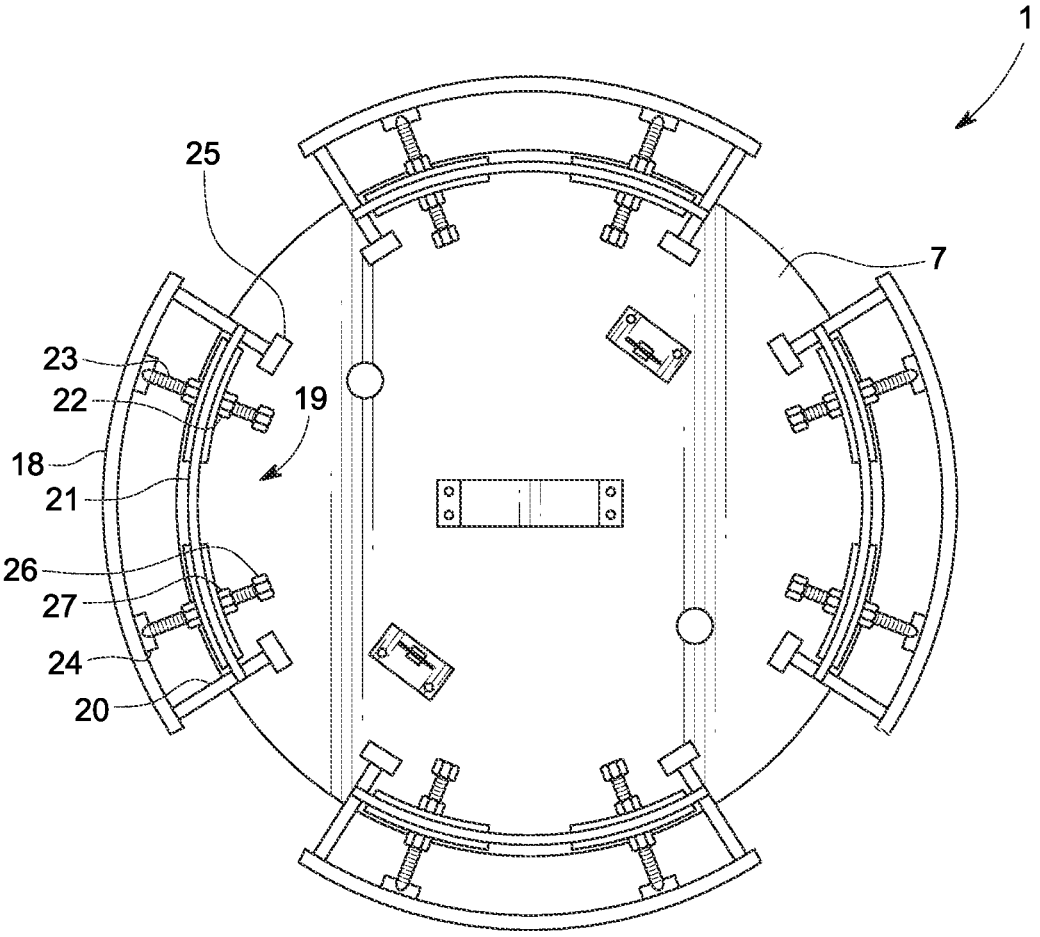
FIG. 7 provides a top perspective view of another embodiment of the present disclosure.

FIG. 7 provides a top perspective view of another embodiment of the cover 1 that does not utilize an inflatable tube to secure the circular central segment 7 to the walls of a manhole. Rather, in this embodiment, the cover 1 comprises a plurality of plates 18 around a perimeter of the central segment 7 that apply pressure to the walls of a manhole via a plurality of tightening mechanisms 19. In this embodiment, each individual tightening mechanism 19 includes two tracks 20 and a second plate 21 in addition to the first plate 18. The second plate 21 is attached to two internally threaded screw casings 22 with a bolt screw 23 extending through each of the casings 22. When fully or partially screwed into the casings 22, a distal end 24 of each of the bolt screws 23 physically contacts the first plate 18.

The second plate 21 is attached to the central segment of the cover 1, a flat plate. Four inner and outer curved pieces are connected to the second, curved plate 21. Inside each curved piece is an internally threaded section to receive the long bolt screw 23 with the tapered end. The threaded section is also externally threaded to accommodate two nuts. In addition, the threaded section is flexible within the second plate 21 to adjust to the outer diameter defined by the plurality of first plates 18. The first plate 18 consists of one long curved section with two open boxed areas to receive the long-tapered end bolt 23. The tracks 20 are attached to the first plates 18 and are free to slide in and out under the second plate 21 by a small section removed from the base of the second plate 21. The tracks 20 keep the outer section, namely first plates 18, from falling into the bottom of the concrete structure, and the track stopper 25 is meant to prevent the first plates 18 from separating from the disc of the cover 1 when it is out of a concrete structure, for example, for transporting the cover 1 to storage or another structure.

Figure 8:
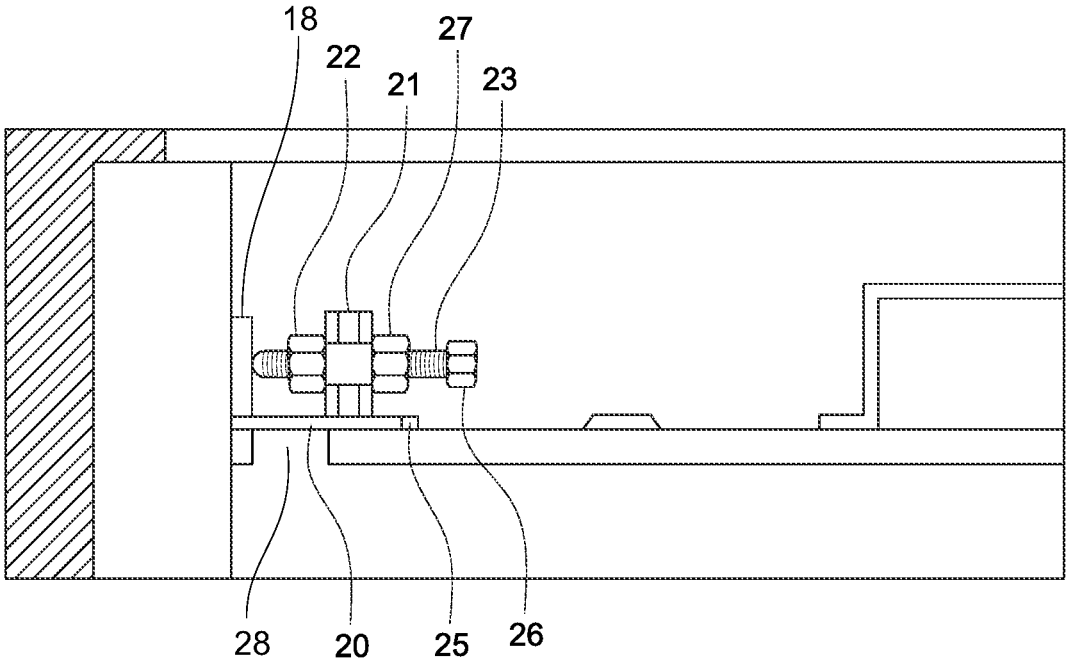
FIG. 8 provides a close-up perspective view of another embodiment of the present disclosure secured to the top of a manhole.
Figure 9:
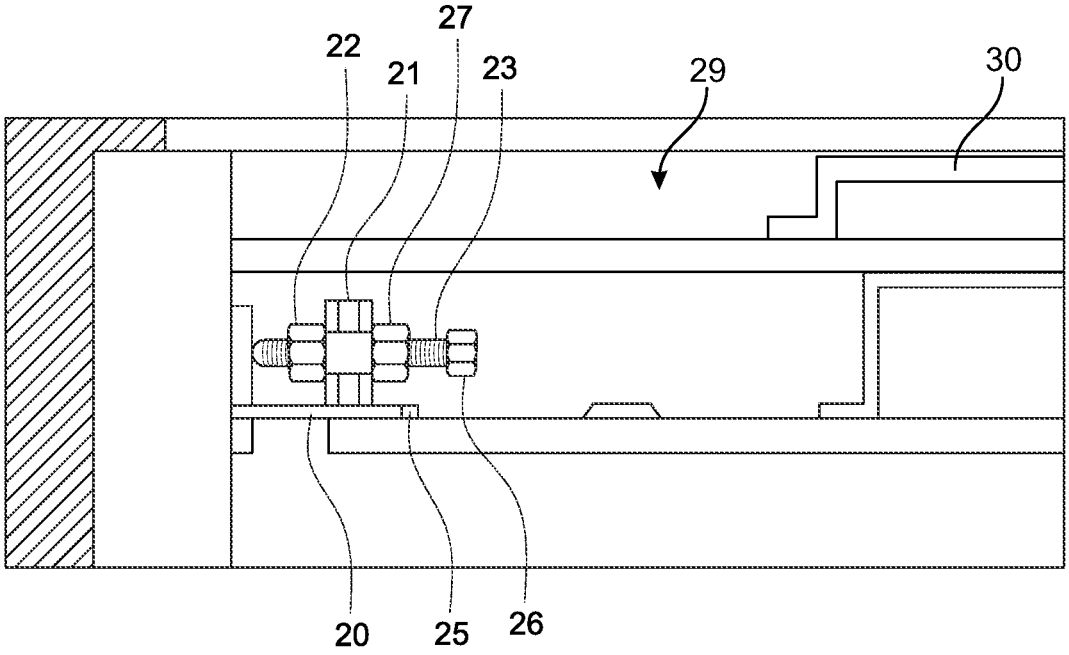
FIG. 9 provides another close-up perspective view of another embodiment of the present disclosure.

In other embodiments, such as the embodiment shown in FIG. 8, where the screw 23 is longer than the track 20, the track stopper 25 may be prevented from any further sliding by the stationarily attached second plate 21. The reason for this is that even when the longer screw 23 is fully tightened, the head of the screw 26 will not physically contact an exterior surface 27 of the casing 22. The inner piece or central segment of the cover 1 is solid except for the two stacking holes 4. However, the area between the edge of the central segment attached to the tightening mechanism 19 and the concrete wall may have an opening 28 of approximately 2". Therefore, in order to prevent debris from falling through the open area around the circumference of the cover 1, an approximately 0.5" thick circular product 29 comprising of rubber or another durable product with an attached handle 30 may be placed over the entire cover 1 comprising the locking mechanisms, as shown in FIG. 9.

A method of using the embodiment of the cover shown in FIGS. 1-6 is also disclosed herein. In this embodiment, the method may comprise the steps of placing the cover at the top of an eccentric cone section of precast concrete, which may be immediately followed by the step of inflating the tube through the air inlet valve until the cover is secured to the walls of the precast concrete. During construction of the manhole or around the manhole, debris may fall on top of the cover. In this scenario, the method disclosed herein may further comprise the step of manually clearing the debris from the top of the cover without the use of additional equipment. The reason additional tools or equipment may be unnecessary to clear debris from the cover is because, in this embodiment, the cover may be secured in the approximately 4" of vertical space at the top of the uppermost section of precast concrete, which is well within the reach of the average construction worker. The method of using the cover may also comprise the step of removing the cover, which may require deflating the tube by releasing air through the air inlet valve and lifting the cover out of the manhole while holding the handle of the cover.

Similarly, a method of the using the embodiment of the cover shown in FIGS. 7-8 is also disclosed. In this embodiment, the method may comprise similar steps to the embodiment disclosed regarding FIGS. 1-6; however, the steps of installing and removing the cover are different due to this embodiment lack of an inflatable tube section. Rather, in this embodiment, installing the cover may comprise the step of twisting the screws in a direction (e.g., preferably a clockwise direction) until each of the plurality of first plates apply a sufficient amount of pressure to the walls of the manhole to prevent the cover from falling. A sufficient amount of pressure may be achieved when at least one of the second plates physically touches the track stopper or when at least one of the screws make contact with an exterior surface of at least one of the screw casings. This embodiment of the cover may also be installed at the same location as the inflatable tube embodiment of the cover, and the steps of cleaning the cover may comprise identical steps regardless of the embodiment. However, in this embodiment, the step of removing the cover may comprise the step of twisting the screws in an opposite direction (e.g., preferably a counter-clockwise direction) until at least one of the plurality of first plates does not apply an pressure to the wall of the manhole. Regardless of the embodiment, after the cover is disengaged from the walls of the manhole, the device may still be removed by lifting it while holding the handle positioned on top of the central segment.

Figure 10:
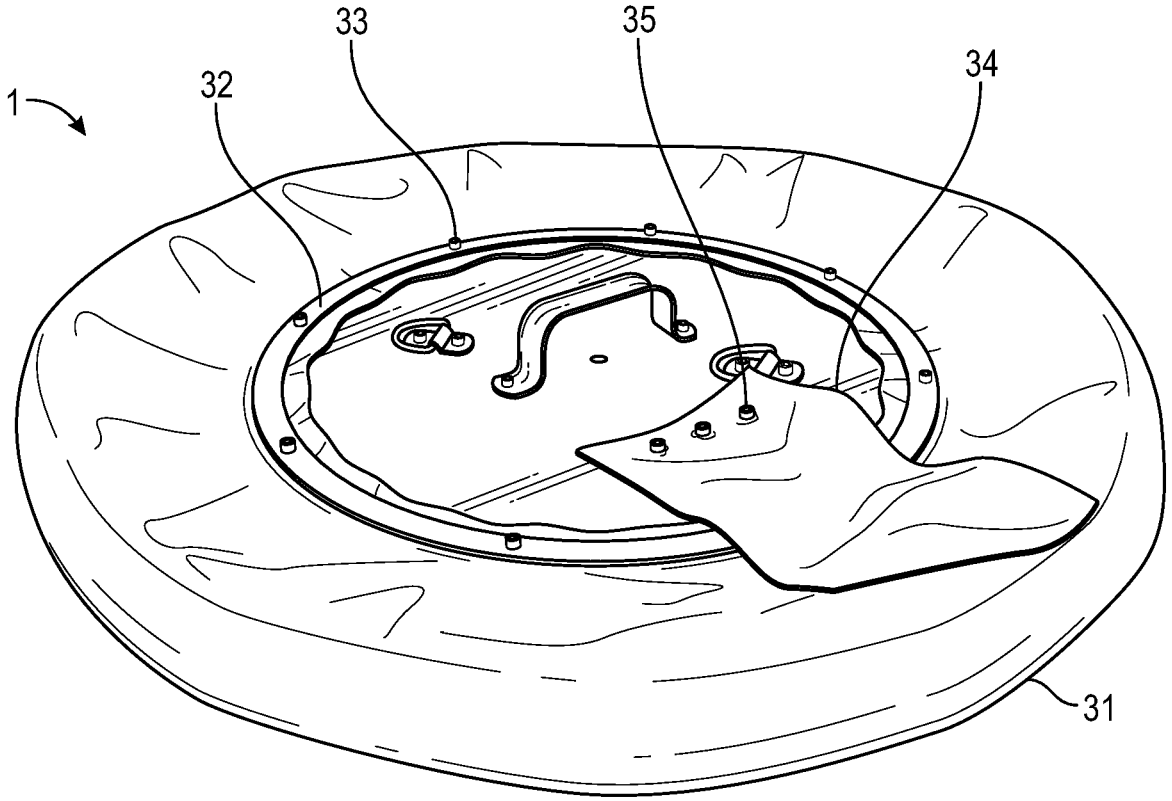
FIG. 10 provides an angled perspective view of a deflated embodiment of the present disclosure.
Figure 11:
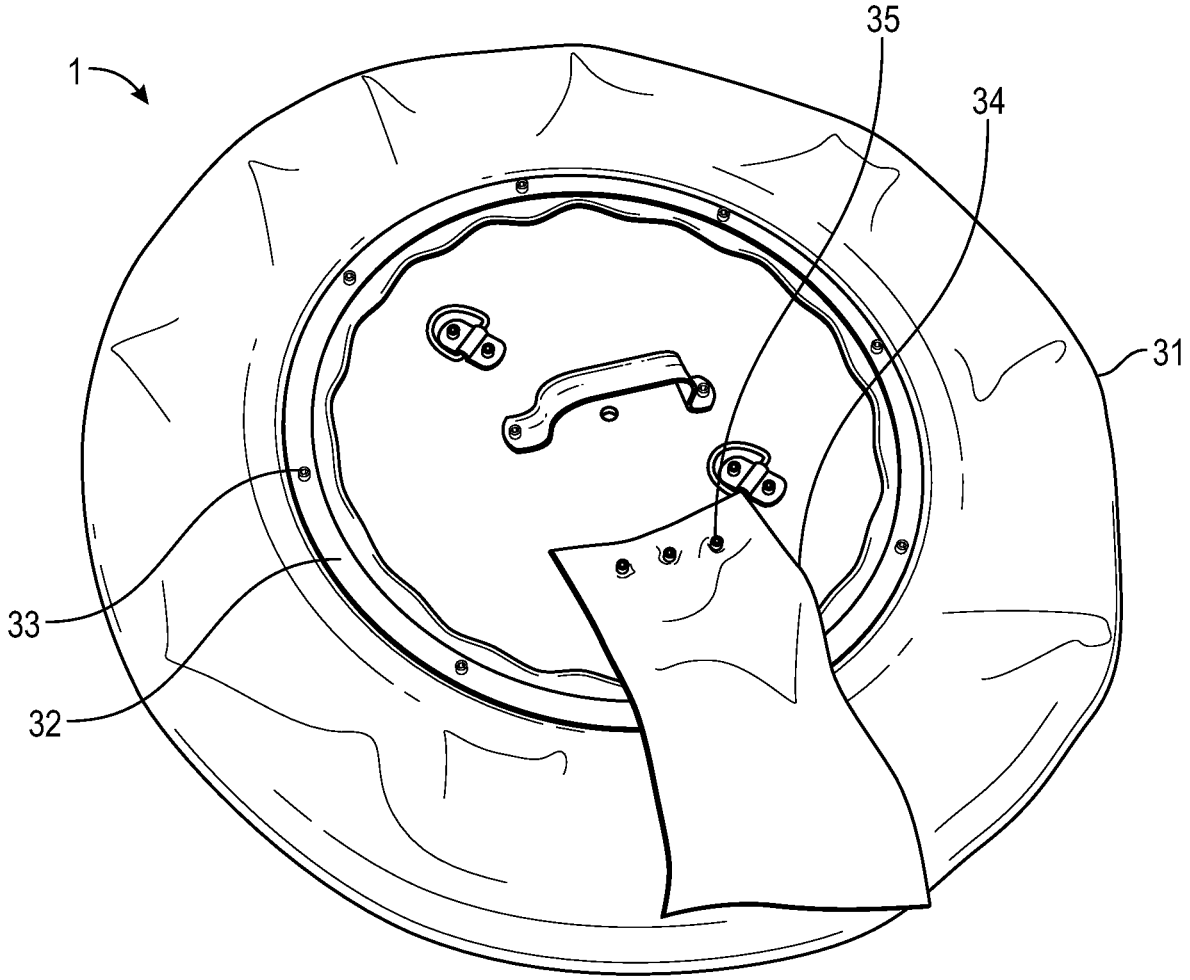
FIG. 11 provides a top perspective view of a deflated embodiment of the present disclosure.

Turning now to FIGS. 10-11, which provide an angled perspective view and a top perspective view, respectively, of another embodiment of the cover 1. In this embodiment, the cover 1 is shown in a deflated state, protected by an apron 31. The purpose of the apron 31 is to prevent large falling debris from damaging the inflatable bladder 10 and also to prevent smaller debris from getting into the inflatable bladder 10, potentially, through the rim 9. In this embodiment, the apron 31 is secured to the cover 1 by a circular fixing piece 32, and the circular fixing piece 32 is secured to the cover by bolts or screws 33. The fixing piece 32 may be necessary to prevent the apron 31 from tearing, as might happen if the apron 31 were secured to the cover 1 only by screws 33. A flap 34 is used to protect the air inlet valve 11. The flap 34 is secured to the cover 1 by bolts or screws 35.

Figure 12:
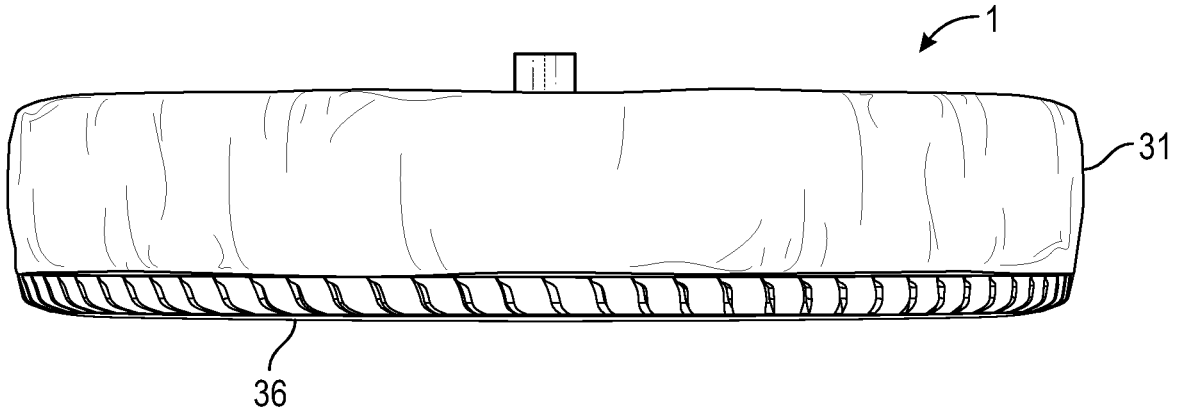
FIG. 12 provides a side perspective view of an inflated embodiment of the present disclosure.
Figure 13:
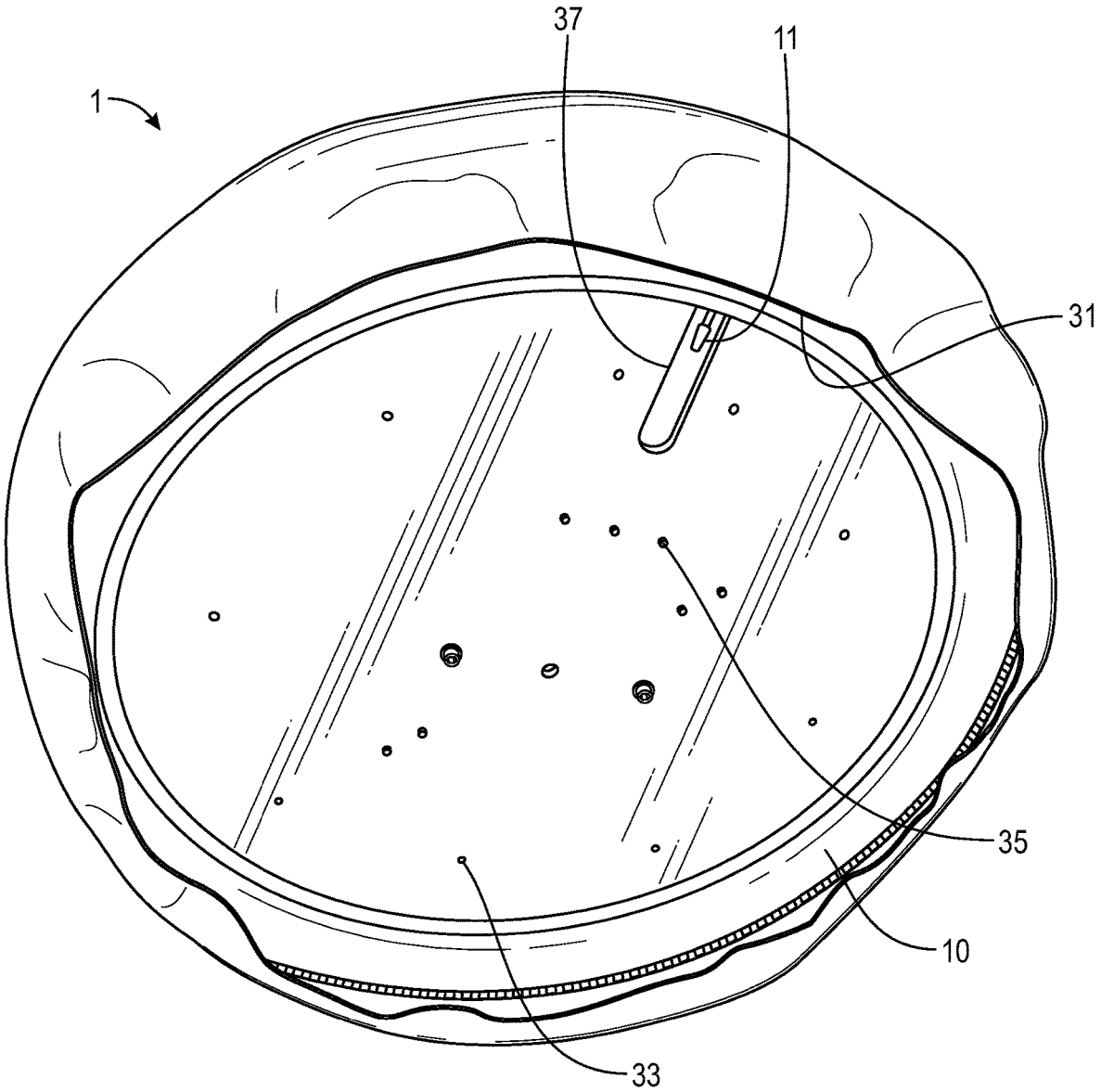
FIG. 13 provides a bottom, angled perspective view of another inflated embodiment of the present disclosure.

FIG. 12 provides a side perspective view of another embodiment of the cover 1 shown in an inflated state. As shown in this non-limiting embodiment, the apron 31 may not extend over the entire tread 36 of the tire 10. FIG. 13 provides a bottom perspective view of yet another embodiment of the cover 1 shown in an inflated state. From the bottom, angled perspective view shown in this non-limiting embodiment, the tire 10 covered by the apron 31 is clearly shown. Also shown are the screws 33 and 35 that secure the fixing piece 32 and the flap 34, respectively, to the cover 1.

In this embodiment, referring still to FIG. 13, the cover 1 defines an elongate aperture 37, which may facilitate inflation of the tire 10 through the air inlet valve 11 by an air pump or other inflating machinery. In this embodiment, the elongate aperture 37 may be necessary due to the horizontal placement of the air inlet valve 11 on the bottom of the taper 8. This placement of the air inlet valve 11 may be considered critical, as a placement of the valve 11 above the plane of the cover may expose it to damage from falling debris. Having the valve 11 protrude horizontally into an elongate aperture 37 while being covered by the flap 34 may provide sufficient protection to the valve 11 from falling debris. The flap 34 may also prevent debris from falling through the elongate aperture 37 and into the bottom of the manhole.

While several variations of the present disclosure have been illustrated by way of example in preferred or particular embodiments, it is apparent that further embodiments could be developed within the spirit and scope of the present disclosure, or the inventive concept thereof. However, it is to be expressly understood that elements described in one embodiment may be incorporated with any other embodiment in combination with any other elements disclosed herein in the various embodiments. It is also to be expressly understood that any modifications and adaptations to the present disclosure are within the spirit and scope of the present disclosure, and are inclusive, but not limited to the following appended claims as set forth.

What is claimed is:

1. A device comprising:

a central segment having a top, a bottom, and a perimeter;

wherein the central segment comprises a taper and a lip around the perimeter of the central segment;

an inflatable element, wherein the inflatable element is attached to the lip around the perimeter of the central segment;

wherein the top of the central segment comprises a handle;

a flap placed on top of the central segment, one end of the flap secured to the central segment via bolts or screws;

wherein, the central segment includes an elongated aperture;

an air inlet valve located on the taper, used to inflate and deflate the inflatable element;

wherein, the air inlet valve protrudes horizontally into the elongated aperture;

wherein, the flap covers the elongated aperture and the air inlet valve.

2. The device of claim 1 further comprising an apron encompassing an entirety of the inflatable element.

3. The device of claim 2 wherein the apron is secured to the central segment by a fixing piece.

4. The device of claim 3 wherein the fixing piece is circular and secured to the central segment by a plurality of screws.

5. The device of claim 1 further comprising a caulking layer between the inflatable element and the lip of the central segment.

6. The device of claim 1 further comprising a lifting ring on the top of the central segment.

7. The device of claim 1 wherein the inflatable element is an inflatable tire.

8. The device of claim 1 wherein the central segment is generally circular in shape and comprises a diameter.

9. The device of claim 8 wherein the diameter of the central segment is less than approximately thirty inches.

10. A device comprising:

a central segment having a top, a bottom, and a perimeter;

wherein the central segment comprises a taper and a lip around the perimeter of the central segment;

an inflatable element, wherein the inflatable element is attached to the lip around the perimeter of the central segment;

wherein the top of the central segment comprises a handle;

an apron made of a pliable material, covering an entirety or most of the inflatable element, protecting the inflatable element from falling debris;

wherein, the apron wraps over the inflatable element.

* * * * *